US007639223B2

(12) United States Patent
Furukoshi et al.

(10) Patent No.: US 7,639,223 B2
(45) Date of Patent: Dec. 29, 2009

(54) LIQUID CRYSTAL DISPLAY APPARATUS DETECTING A FREEZE STATE

(75) Inventors: Yasutake Furukoshi, Kawasaki (JP); Katsuyoshi Hiraki, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 510 days.

(21) Appl. No.: 11/385,879

(22) Filed: Mar. 22, 2006
(Under 37 CFR 1.47)

(65) Prior Publication Data

US 2007/0052873 A1 Mar. 8, 2007

(30) Foreign Application Priority Data

Mar. 23, 2005 (JP) ..... 2005-084543

(51) Int. Cl.
*G09G 3/36* (2006.01)

(52) U.S. Cl. ..... 345/87; 348/98

(58) Field of Classification Search ..... 345/87, 345/96, 98, 100, 84, 50–52; 348/515–526, 348/790
See application file for complete search history.

(56) References Cited

U.S. PATENT DOCUMENTS 4,403,250 A * 9/1983 Kellar ..... 386/110
5,491,706 A * 2/1996 Tagawa et al. ..... 714/812
6,950,144 B2 * 9/2005 Chae ..... 348/513
7,424,160 B1 * 9/2008 Basse ..... 382/236
2004/0179002 A1 * 9/2004 Park et al. ..... 345/204
2004/0233189 A1 * 11/2004 Masuda et al. ..... 345/204

FOREIGN PATENT DOCUMENTS

JP 05-053541 3/1993
JP 05-056374 3/1993

* cited by examiner

*Primary Examiner*—Chanh Nguyen
*Assistant Examiner*—Tsegaye Seyoum
(74) *Attorney, Agent, or Firm*—Harness, Dickey & Pierce, P.L.C.

(57) ABSTRACT

A liquid crystal display apparatus includes a liquid crystal panel, a driver configured to drive the liquid crystal panel, a control circuit configured to control the driver in response to a display data signal and control signal supplied from an exterior, and a check circuit configured to detect a change between frames in a detection-purpose signal that is included in at least one of the display data signal and control signal so as to output a check signal responsive to presence/absence of the change.

7 Claims, 14 Drawing Sheets

LIQUID CRYSTAL DISPLAY APPARATUS DETECTING A FREEZE STATE

BACKGROUND OF THE INVENTION

1. Field of the Invention

The present invention generally relates to an image display apparatus, and particularly relates to a liquid crystal display apparatus.

2. Description of the Related Art

In a liquid crystal display (LCD) panel, pixels each including a transistor are arranged in matrix form, with gate bus lines extending in the horizontal direction being connected to the gates of the pixel transistors, and data bus lines extending in the vertical direction being coupled to the pixel electrodes of the pixels via the transistors. Each pixel electrode is positioned to face a common electrode (opposite electrode) across a liquid crystal layer, thereby forming a condenser corresponding to each pixel. When data is to be displayed on a liquid crystal panel, the gate driver drives the gate bus lines one after another so as to make the transistors conductive for one line, and the data driver writes data for one horizontal line to the pixels simultaneously via the conductive transistors.

In order to display a desired image by writing display data at proper timing to the liquid crystal panel having the configuration as described above, a timing controller is provided in the liquid crystal display apparatus. This timing controller receives a clock signal, display data, and a display enable signal indicative of the timing of the display position from an apparatus on the host side (television tuner, computer, or the like). The timing controller counts the clock pulses of the clock signal starting from a rise of the display enable signal so as to determine timing in the horizontal position, thereby generating various control signals. The timing controller also counts the number of display enable signals so as to determine timing in the vertical position, thereby generating various control signals. The timing controller further detects the portion of the display enable signal at which the LOW period continues for more than a predetermined number of clock pulses, thereby detecting the position of the start of each frame.

In general, all that such liquid crystal display apparatus does is display the display data supplied from the host apparatus based on the timing signals supplied from the host apparatus. Accordingly, when the host apparatus hangs-up, for example, resulting in its display data being frozen, the liquid crystal display apparatus continues to display the frozen display data supplied from the host side. In this case, it is impossible to distinguish between a state in which display data of proper operation does not show any change and a state in which the display data is frozen due to operation failure.

If frozen display data as described above continues to be displayed in a system relating to the operation of a ship or the like, for example, decisions and determinations for the operation are made by mistake based on the information displayed on the display screen that is being frozen. Such a situation may lead to grave consequences in which human lives may be lost. It is thus unacceptable to fail to detect an abnormal state.

[Patent Document 1] Japanese Patent Application Publication No. 5-053541

[Patent Document 2] Japanese Patent Application Publication No. 5-056374

Accordingly, there is a need for a liquid crystal display apparatus that can detect a freeze state of the display data if the display data supplied from a host apparatus is frozen.

SUMMARY OF THE INVENTION

It is a general object of the present invention to provide liquid crystal display apparatus that substantially obviates one or more problems caused by the limitations and disadvantages of the related art.

It is another and more specific object of the present invention to provide a liquid crystal display apparatus, a control circuit, and a method of checking liquid crystal display data that can detect a freeze state of the display data if the display data supplied from a host apparatus is frozen.

To achieve these and other advantages in accordance with the purpose of the invention, a liquid crystal display apparatus includes a liquid crystal panel, a driver configured to drive the liquid crystal panel, a control circuit configured to control the driver in response to a display data signal and control signal supplied from an exterior, and a check circuit configured to detect a change between frames in a detection-purpose signal that is included in at least one of the display data signal and control signal so as to output a check signal responsive to presence/absence of the change.

Further, a control circuit according to the present invention is configured to be connectable to a unit that includes a liquid crystal panel and a driver for driving the liquid crystal panel, and configured to control the driver based on a display data signal and control signal supplied from an exterior. The control circuit includes a check circuit configured to detect a change between frames in a detection-purpose signal that is included in at least one of the display data signal and control signal so as to output a check signal responsive to presence/absence of the change.

Moreover, a method of checking liquid crystal display data according to the present invention includes receiving a display data signal and control signal, controlling a driver for driving a liquid crystal panel based on the display data signal and control signal, detecting a change between frames in a detection-purpose signal that is included in at least one of the display data signal and control signal, and generating a check signal responsive to presence/absence of the change.

According to at least one embodiment of the present invention, the display data or a related timing signal supplied from the host apparatus has a freeze-detection-purpose signal inserted thereinto in order to allow the freeze state of the display data to be detected at the liquid crystal display apparatus. The liquid crystal display apparatus detects a change of the freeze-detection-purpose signal between frames, and makes a determination in response to the presence/absence of the change, thereby generating a check signal indicative of whether the display data is frozen.

This check signal may be supplied to the host apparatus, for example, to inform of the anomaly of the display data. Alternatively, a circuit may be provided to display a notice or mark indicative of the freeze state of the display data on the LCD panel, and the check signal may be used as a trigger to activate this circuit. Alternatively, a circuit may be provided to generate a sound alarm or the like indicative of the freeze state of the display data, and the check signal may be used as a trigger to activate this circuit.

DESCRIPTION OF THE PREFERRED EMBODIMENTS

In the following, embodiments of the present invention will be described in detail with reference to accompanying drawings.

Figure 1:
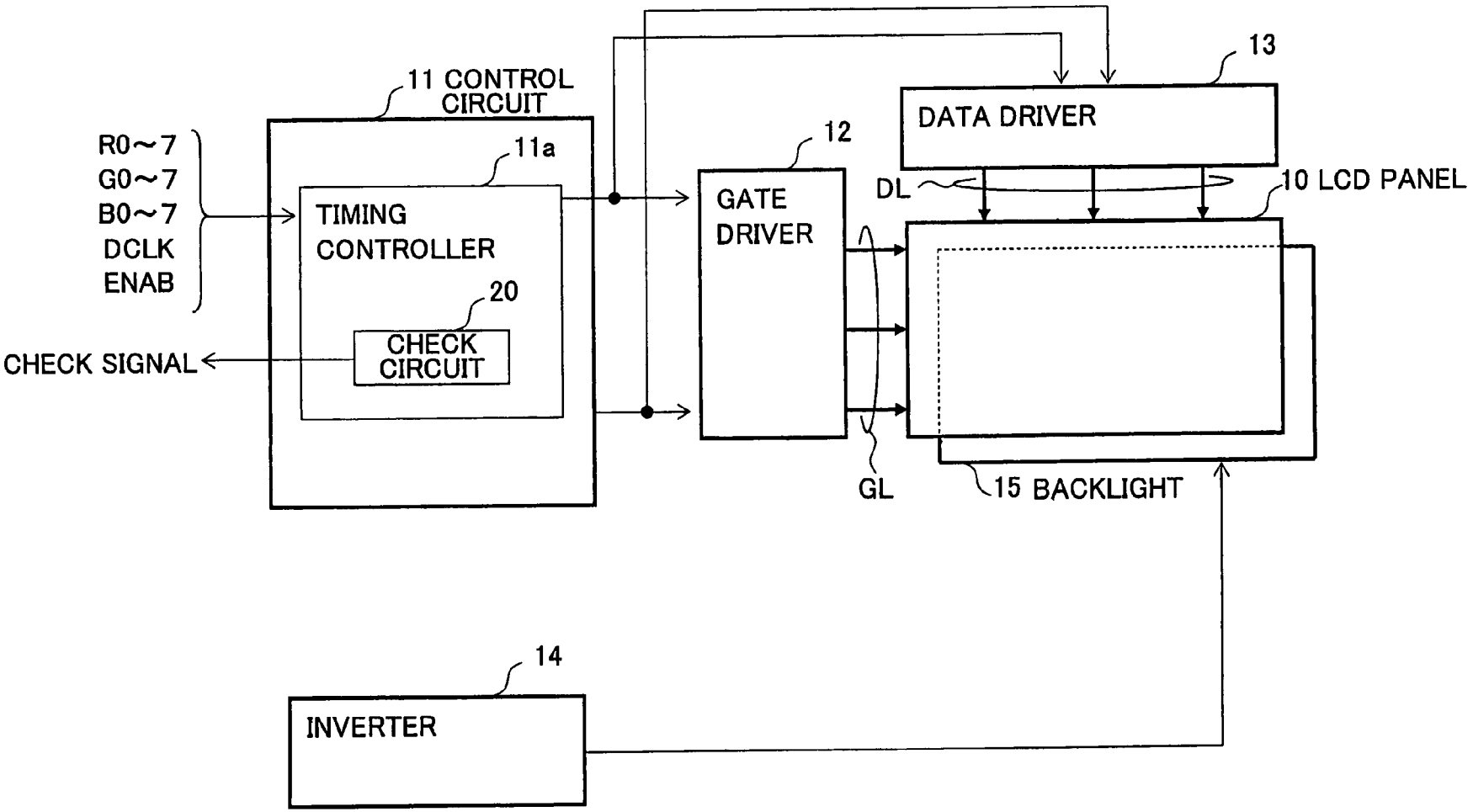
FIG. 1 is a drawing showing the configuration of a liquid crystal display apparatus according to the present invention.

FIG. 1 is a drawing showing the configuration of a liquid crystal display apparatus according to the present invention.

The liquid crystal display apparatus of FIG. 1 includes an LCD panel 10, a control circuit 11, a gate driver 12, a data driver 13, an inverter circuit 14, and a backlight 15. The LCD panel 10 has pixels each including a transistor arranged in matrix form. Gate bus lines GL extending in the horizontal direction from the gate driver 12 are connected to the gates of the transistors of the pixels, and data bus lines DL extending in the vertical direction from the data driver 13 serve to write pixel data to the pixel electrodes via the transistors.

A timing controller 11*a* of the control circuit 11 receives a display data signal and various control signals (timing signals) from a host apparatus via an interface. The display data signal and various control signals (timing signals) include a clock signal DCLK, display data RGB0-7, and a display enable signal ENAB indicative of the timing of display position. The timing controller 11*a* counts the clock pulses of the clock signal starting from a rise of the display enable signal so as to determine timing in the horizontal position, thereby generating various control signals for driving the drivers. The timing controller 11*a* also counts the number of display enable signals so as to determine timing in the vertical position, thereby generating various control signals for driving the drivers. The timing controller 11*a* further detects the portion of the display enable signal at which the LOW period continues for more than a predetermined number of clock pulses, thereby making it possible to detect the position of the start of each frame.

The control signals supplied from the timing controller 11*a* to the gate driver 12 include a gate clock signal and a start pulse signal. The gate clock signal is a synchronizing signal for shifting a driven gate bus line one by one in synchronization with a rise of the signal. To be specific, the transistors for one horizontal line having their gates switched on are shifted on a line-by-line basis in the vertical direction in synchronization with a rise in the gate clock signal. The start pulse signal is a synchronizing signal for specifying the timing at which the first gate bus line is turned on, and corresponds to the start timing of a frame.

The control signals supplied from the timing controller 11*a* to the data driver 13 include a dot clock signal, a data start signal, a latch pulse, and a polarity signal. The dot clock signal has clock pulses used to load the display data to a register in synchronization with its rising edges. The data start signal serves to indicate the start position of the display data that is to be displayed by a corresponding data driver 13. Using the timing of the data start signal as a start point, the display data corresponding to individual pixels are loaded to the register one by one in response to the dot clock signal. The latch pulse serves to cause an internal latch to latch the display data successively loaded in the register. The latched display data is transferred to a DA converter, which converts the display data into analog gray-scale signals, which are then output to the LCD panel 10 as data bus line drive signals. The polarity signal is input into the DA converter to indicate the output polarity of each data bus line. Since the output polarity of each data bus line needs to be temporally reversed in order to prevent the degradation of liquid crystal characteristics, the polarity signal is used to select the output polarity of each data bus line relative to the common potential.

The inverter circuit 14 generates a high voltage for lighting a cold cathode tube based on the direct power supply voltage for provision to the backlight 15. The backlight 15 shines light on the LCD panel 10 from its back side.

According to the present invention, the timing controller 11*a* is provided with a check circuit 20, which detects a freeze state of the display data to assert a check signal when the display data supplied to the timing controller 11*a* is frozen. This check signal may be supplied to the host apparatus, for example, to inform of the anomaly of the display data. Alternatively, a circuit may be provided to display a notice or mark indicative of the freeze state of the display data on the LCD panel 10, and the check signal may be used as a trigger to activate this circuit. Alternatively, a circuit may be provided to generate a sound alarm or the like indicative of the freeze state of the display data, and the check signal may be used as a trigger to activate this circuit.

In the present invention, the display data or a related timing signal supplied from the host apparatus has a freeze-detection-purpose signal inserted thereinto in order to allow the freeze state of the display data to be detected at the liquid crystal display apparatus. The liquid crystal display apparatus checks whether the display data is frozen based on this signal.

Figure 2A:
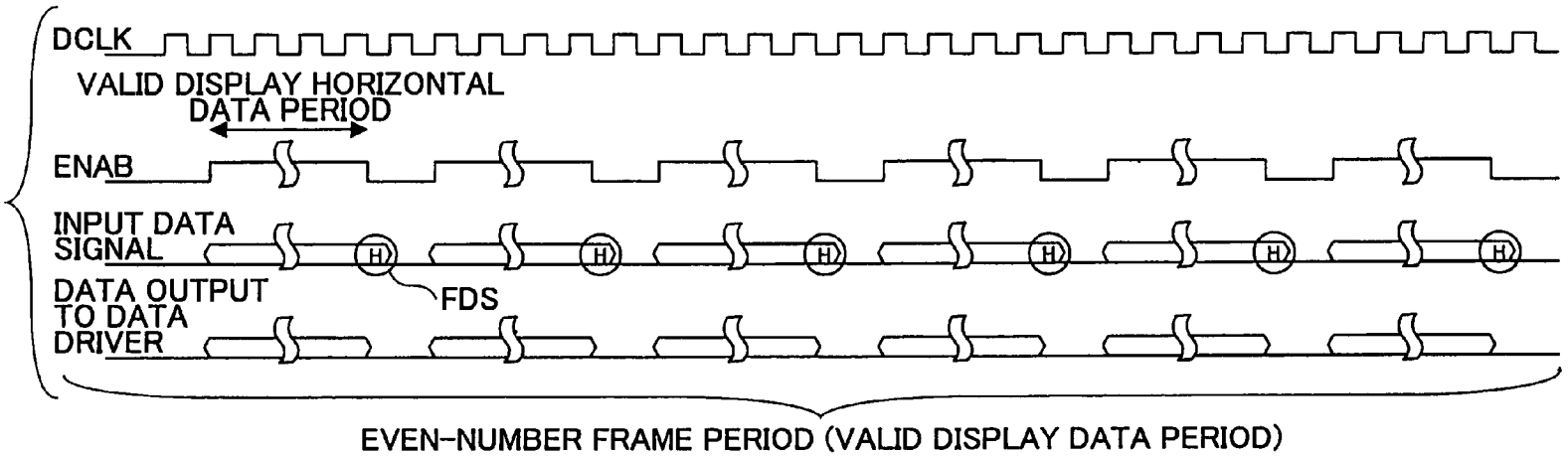
FIGS. 2A and 2B are drawings showing a first embodiment of the freeze-detection-purpose signal.
Figure 2B:
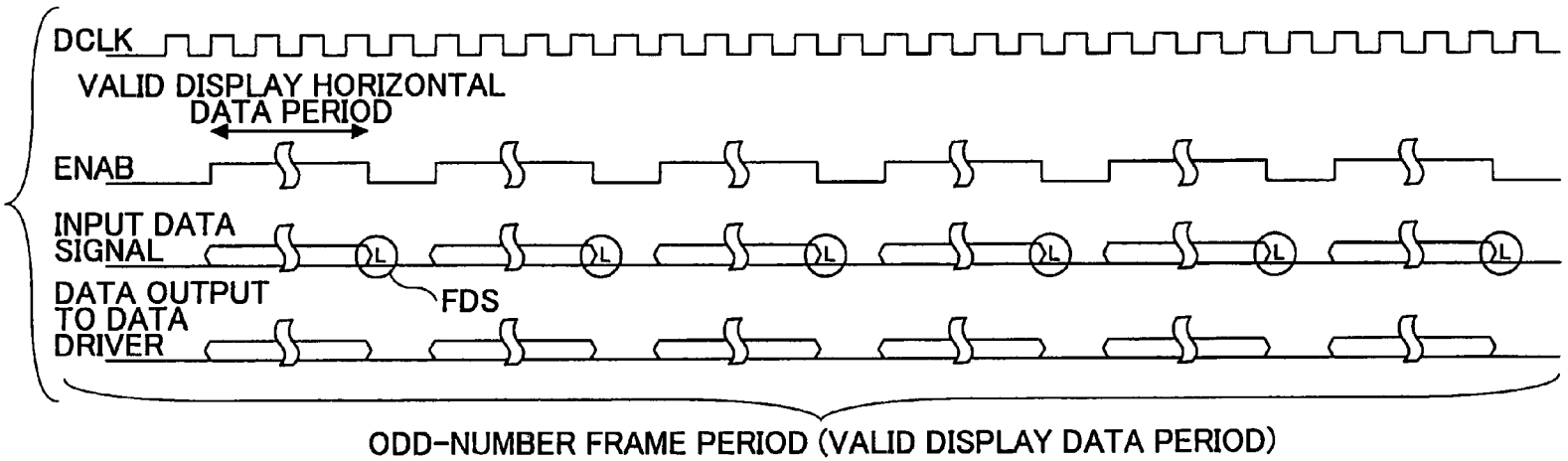

FIGS. 2A and 2B are drawings showing a first embodiment of the freeze-detection-purpose signal. FIGS. 2A and 2B show the dot clock signal DCLK, the display enable signal ENAB, an input data signal (display data to be input into the liquid crystal display apparatus), and a data output to the data driver. The display enable signal ENAB serves to indicate a valid period of display data by becoming HIGH during the valid period of the display data in each horizontal cycle. The signals shown in FIG. 2A correspond to those of an even frame, for example, and the signals shown in FIG. 2B correspond to those of an odd frame.

In the first embodiment, as shown in FIGS. 2A and 2B, a freeze-detection-purpose signal FDS is added at the end of the display data signal in each horizontal cycle. The freeze-detection-purpose signal FDS is HIGH ("1") in the even frame as shown in FIG. 2A and LOW ("0") in the odd frame as shown in FIG. 2B. At the liquid crystal display apparatus, a check is made as to whether the freeze-detection-purpose signal FDS is reversed (inverted) from frame to frame. If the freeze-detection-purpose signal FDS is not reversed from frame to frame, it is ascertained that the display data is frozen, thereby asserting the check signal.

Figure 3:
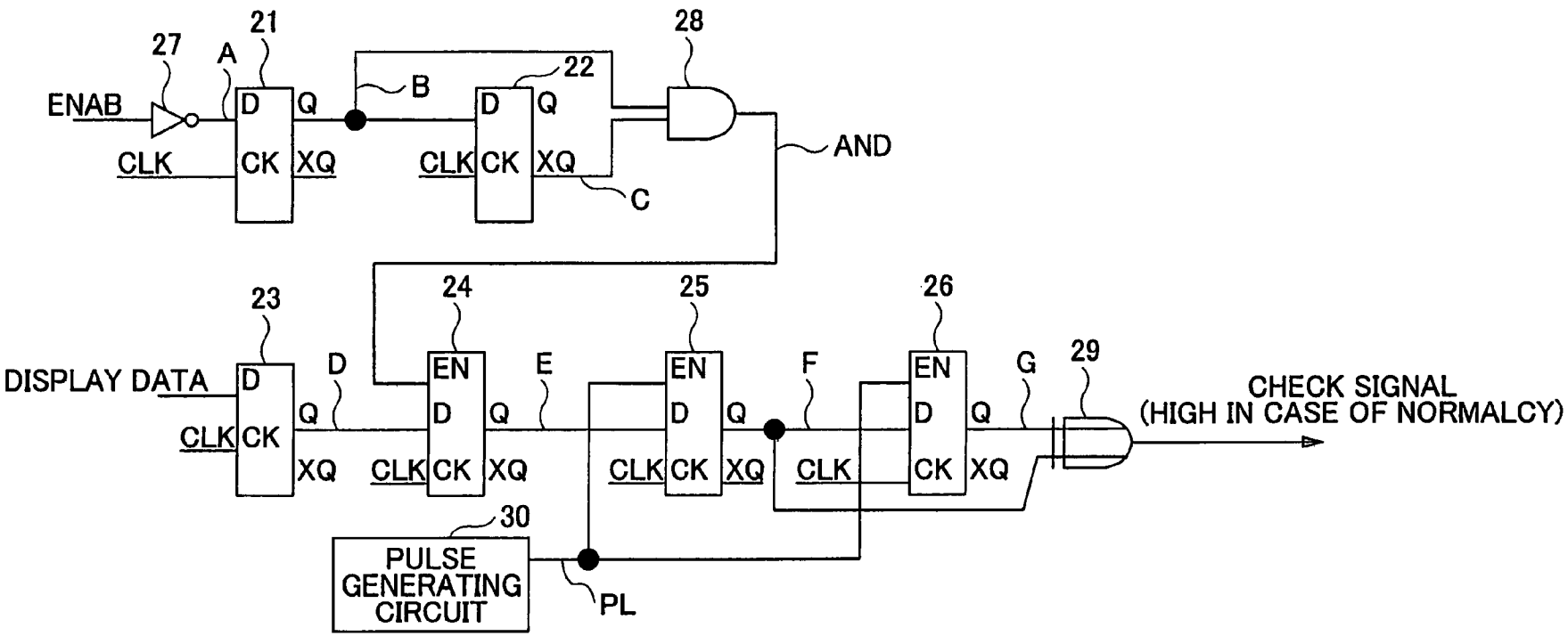
FIG. 3 is a drawing showing an example of the circuit configuration of the check circuit corresponding to the first embodiment.

FIG. 3 is a drawing showing an example of the circuit configuration of the check circuit 20 corresponding to the first embodiment. The check circuit 20 of FIG. 3 includes flip-flops 21 through 26, an inverter 27, an AND gate 28, an XOR gate 29, and a pulse generating circuit 30.

The circuit configuration shown in FIG. 3 is designed to generate a check signal based on the freeze-detection-purpose signal when the freeze-detection-purpose signal is added at the end of a display data signal in each horizontal cycle. The circuit portion comprised of the inverter 27, the flip-flop 21, the flip-flop 22, and the AND gate 28 generates a pulse based on the display enable signal ENAB and the clock signal CLK, such that the pulse becomes HIGH at the clock timing immediately following the period indicated by the display enable signal ENAB.

The circuit portion comprised of the flip-flop 23 and the flip-flop 24 serves to extract, based on the pulse generated as described above, the freeze-detection-purpose signal added at the end of a display data in each horizontal cycle. The freeze-detection-purpose signal switches its value between "0" and "1" from vertical cycle (frame) to vertical cycle (frame) (i.e., assumes "0" and "1" alternately).

The pulse generating circuit 30 serves to generate a pulse at the end of each vertical cycle (i.e., at the end of each frame). The circuit portion comprised of the flip-flop 25, the flip-flop 26, and the XOR gate 29 performs an XOR (exclusive OR) operation, based on the pulse generated by the pulse generating circuit 30, between the value of the freeze-detection-purpose signal of a given frame and the value of the freeze-detection-purpose signal of the following frame. As a result, the check signal becomes LOW that is an asserted state to indicate an anomaly if the value of the freeze-detection-purpose signal of a given frame is the same as the value of the freeze-detection-purpose signal of the next frame. The check signal becomes HIGH that is a negated state to indicate a normal state if the situation is normal, i.e., if the value of the freeze-detection-purpose signal of a given frame differs from the value of the freeze-detection-purpose signal of the next frame.

Figure 4:
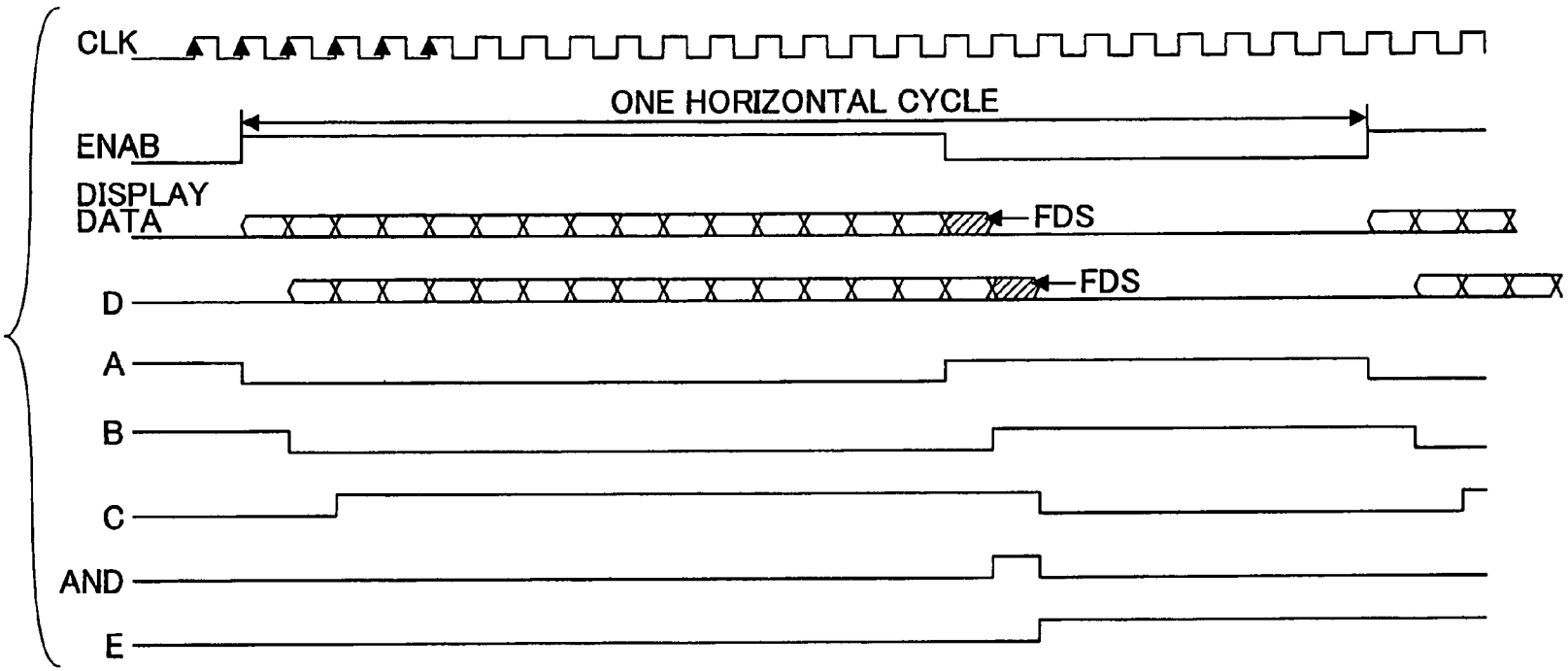
FIG. 4 is a timing chart showing the operation of the circuit of FIG. 3 for a given horizontal cycle.
Figure 5:
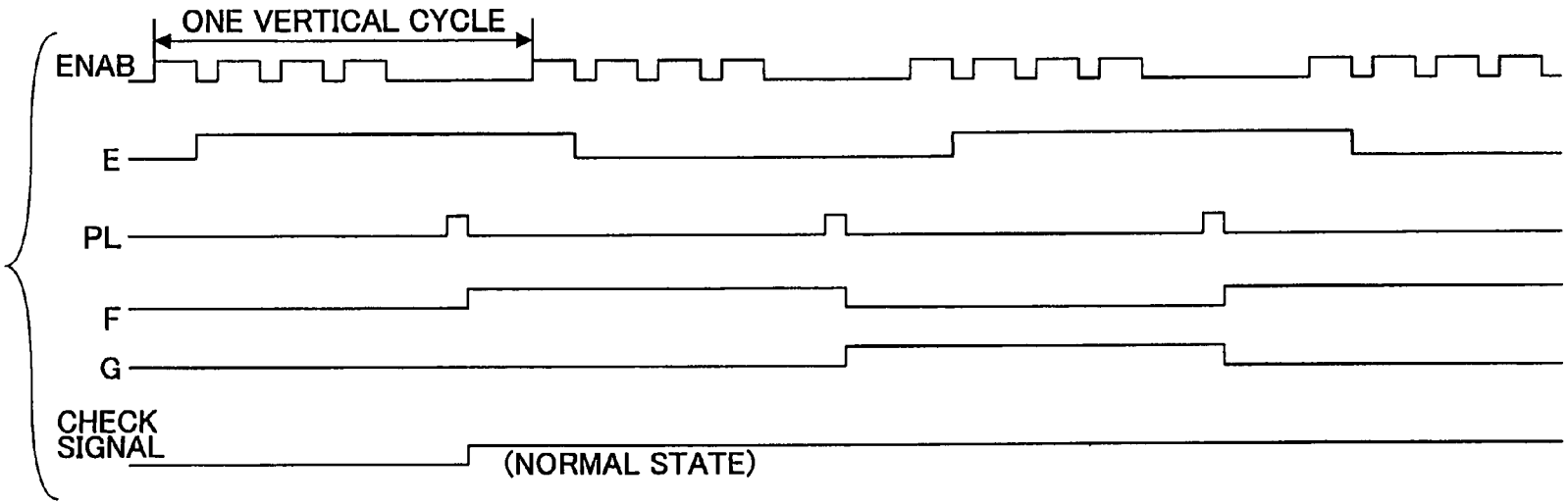
FIG. 5 is a timing chart showing the operation of the circuit of FIG. 3 for a given vertical cycle.

FIG. 4 is a timing chart showing the operation of the circuit of FIG. 3 for a given horizontal cycle. FIG. 5 is a timing chart showing the operation of the circuit of FIG. 3 for each vertical cycle. The operation of the circuit of FIG. 3 will be described with reference to FIG. 4 and FIG. 5.

The individual signals shown in FIG. 4 and FIG. 5 are illustrated in the circuit diagram of FIG. 3 to indicate their positions. A signal A is the output of the inverter 27, a signal B the non-inverted output of the flip-flop 21, a signal C the inverted output of the flip-flop 22, a signal AND the output of the AND gate 28, a signal D the non-inverted output of the flip-flop 23, a signal E the non-inverted output of the flip-flop 24, a signal F the non-inverted output of the flip-flop 25, a signal G the non-inverted output of the flip-flop 26, a signal PL the output of the pulse generating circuit 30, and the check signal the output of the XOR gate 29.

As shown in FIG. 4, the display enable signal ENAB serves to indicate a valid period of display data by becoming HIGH during the valid period of the display data in each horizontal cycle. In each horizontal cycle, the freeze-detection-purpose signal FDS is attached to the end of the display data. Since the display enable signal ENAB serves to indicate the valid data position, the display enable signal ENAB comes to an end (changes to LOW) at the clock timing immediately preceding the freeze-detection-purpose signal FDS.

The inverter 27 inverts the display enable signal ENAB to produce the signal A. The signal A is delayed by one clock by the flip-flop 21 to generate the signal B. Further, the signal B is delayed by one clock and inverted by the flip-flop 22 to generate the signal C. The AND gate 28 performs an AND operation between the signal B and the signal C, thereby producing the signal AND, which becomes HIGH at the clock timing immediately following the freeze-detection-purpose signal FDS.

In order to be aligned with the position of the signal AND, the display data is delayed by one clock by the flip-flop 23 to generate the signal D. The timing of the freeze-detection-purpose signal FDS contained in this signal D matches the timing of the pulse of the signal AND. The flip-flop 24 loads the signal D by use of the signal AND as an enable signal, thereby generating the signal E indicating the value of the freeze-detection-purpose signal FDS. In the example shown in FIG. 4, the signal E is "1" (HIGH).

Turning to FIG. 5, the signal E generated as described above changes its value from vertical cycle to vertical cycle (i.e., from frame to frame) The pulse generating circuit 30 generates a pulse that becomes HIGH at the end of each frame, as shown in FIG. 5. The flip-flop 25 loads the signal E by use of this pulse as an enable signal, thereby generating the signal F indicating the value of the freeze-detection-purpose signal FDS for each frame.

The flip-flop 26 loads the signal F by use of the pulse of the pulse generating circuit 30 as an enable signal, thereby generating the signal G that is delayed by one vertical cycle (by one frame) from the signal F. The XOR gate 29 performs an exclusive OR operation between the signal F and the signal G to produce the check signal.

Since the freeze-detection-purpose signal FDS is reversed from frame to frame in the normal condition, the signal F is also reversed from frame to frame. The signal G is delayed by one frame from the signal F. It can thus be ascertained that the display data is normal if the signal F and the signal G are different. In this case, the check signal is set to HIGH. If the signal F and the signal G are identical, the freeze-detection-purpose signal FDS is not reversed from frame to frame, which makes it possible to ascertain that the display data is frozen. In this case, the check signal is set to LOW.

Figure 6A:
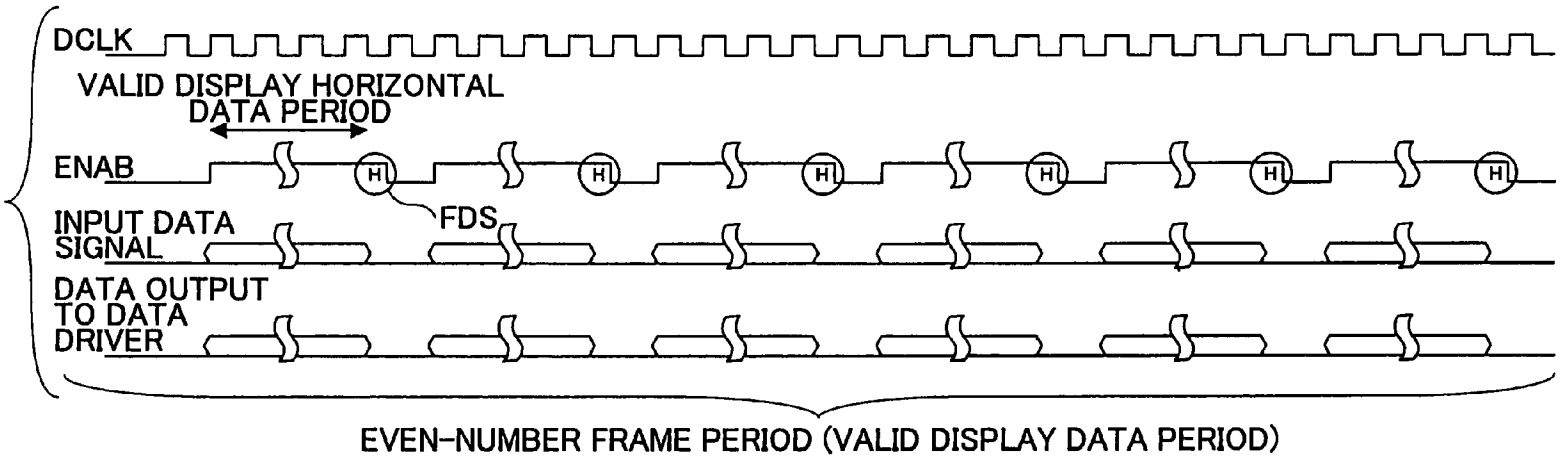
FIGS. 6A and 6B are drawings showing a second embodiment of the freeze-detection-purpose signal.
Figure 6B:
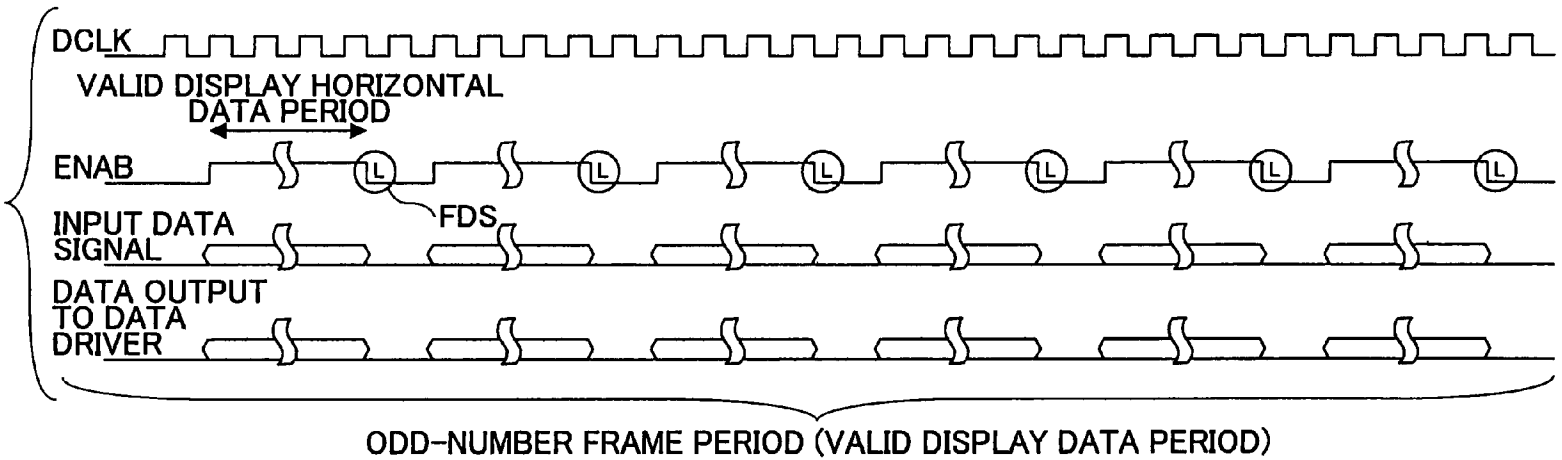

FIGS. 6A and 6B are drawings showing a second embodiment of the freeze-detection-purpose signal. In the second embodiment, as shown in FIGS. 6A and 6B, a freeze-detection-purpose signal FDS is added at the end of the display enable signal ENAB in each horizontal cycle. The freeze-detection-purpose signal FDS is HIGH ("1") in the even frame as shown in FIG. 6A and LOW ("0") in the odd frame as shown in FIG. 6B. At the liquid crystal display apparatus, a check is made as to whether the freeze-detection-purpose signal FDS is reversed from frame to frame. If the freeze-detection-purpose signal FDS is not reversed from frame to frame, it is ascertained that the display data is frozen, thereby asserting the check signal.

Figure 7:
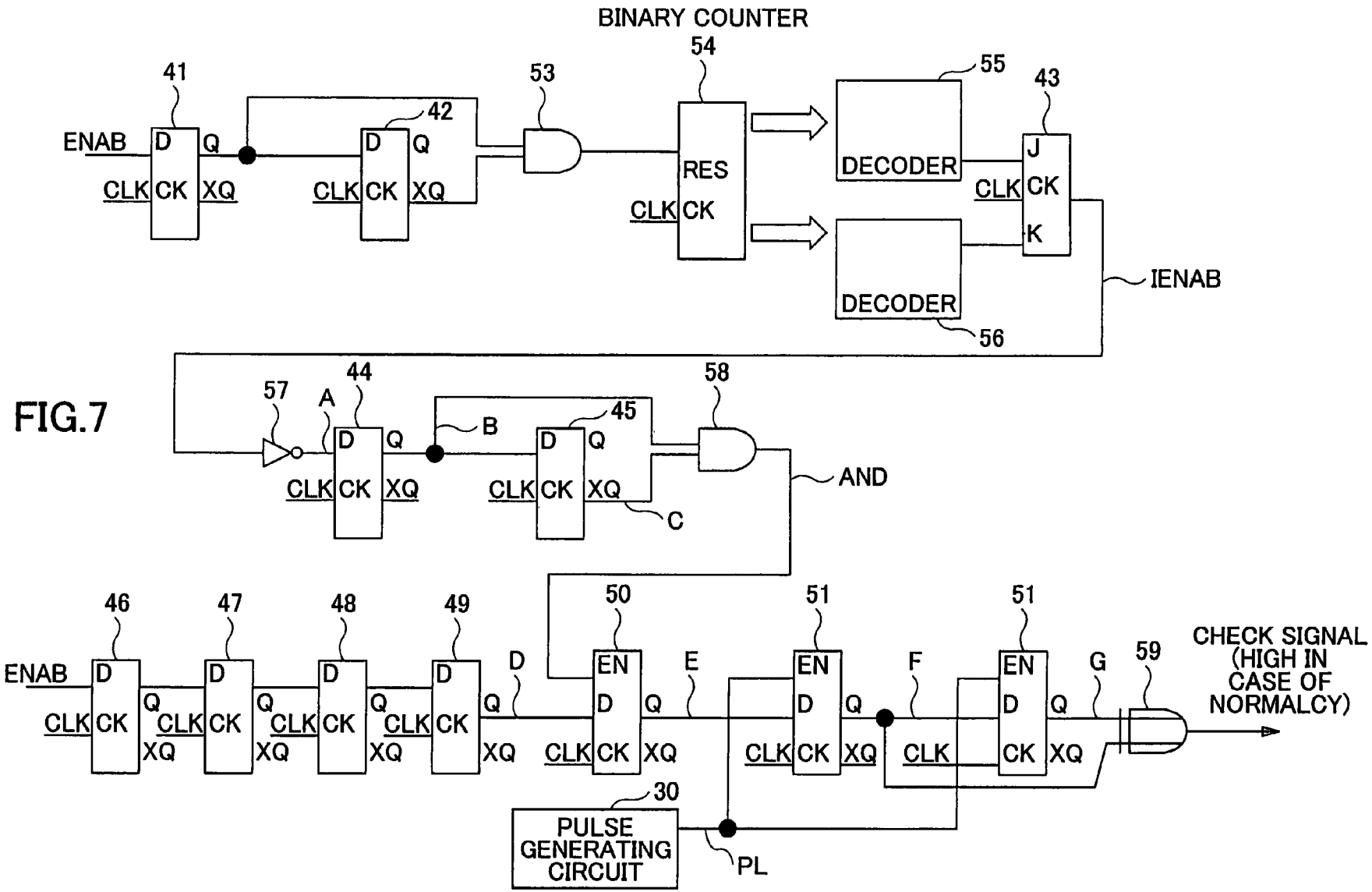
FIG. 7 is a drawing showing an example of the circuit configuration of the check circuit corresponding to the second embodiment.

FIG. 7 is a drawing showing an example of the circuit configuration of the check circuit 20 corresponding to the second embodiment. The check circuit 20 of FIG. 7 includes flip-flops 41 through 52, an AND gate 53, a binary counter 54, decoders 55 and 56, an inverter 57, an AND gate 58, an XOR gate 59, and a pulse generating circuit 30.

The circuit configuration shown in FIG. 7 is designed to generate a check signal based on the freeze-detection-purpose signal when the freeze-detection-purpose signal is added at the end of a display enable signal ENAB in each horizontal cycle. The circuit portion comprised of the flip-flops 41 though 43, the AND gate 53, the binary counter 54, and the decoders 55 and 56 shown in FIG. 7 generates an internal display enable signal IENAB correctly indicating the valid period of display data by removing the signal portion for the last one clock (the portion of the freeze-detection-purpose signal) from the display enable signal ENAB to which the freeze-detection-purpose signal is added.

The circuit portion comprised of the inverter 57, the flip-flop 44, the flip-flop 45, and the AND gate 58 generates a pulse based on the internal display enable signal IENAB and the clock signal CLK, such that the pulse becomes HIGH at the clock timing immediately following the period indicated by the internal display enable signal IENAB.

The flip-flop 46 through the flip-flop 50 serve to extract, based on the pulse generated as described above, the freeze-detection-purpose signal added at the end of the display enable signal ENAB in each horizontal cycle. The freeze-detection-purpose signal switches its value between "0" and "1" from vertical cycle (frame) to vertical cycle (frame) (i.e., assumes "0" and "1" alternately).

The pulse generating circuit 30 serves to generate a pulse at the end of each vertical cycle (i.e., at the end of each frame). The circuit portion comprised of the flip-flop 51, the flip-flop 52, and the XOR gate 59 performs an XOR (exclusive OR) operation, based on the pulse generated by the pulse generating circuit 30, between the value of the freeze-detection-purpose signal of a given frame and the value of the freeze-detection-purpose signal of the following frame. As a result, the check signal becomes LOW that is an asserted state to indicate an anomaly if the value of the freeze-detection-purpose signal of a given frame is the same as the value of the freeze-detection-purpose signal of the next frame. The check signal becomes HIGH that is a negated state to indicate a normal state if the situation is normal, i.e., if the value of the freeze-detection-purpose signal of a given frame differs from the value of the freeze-detection-purpose signal of the next frame.

Figure 8:
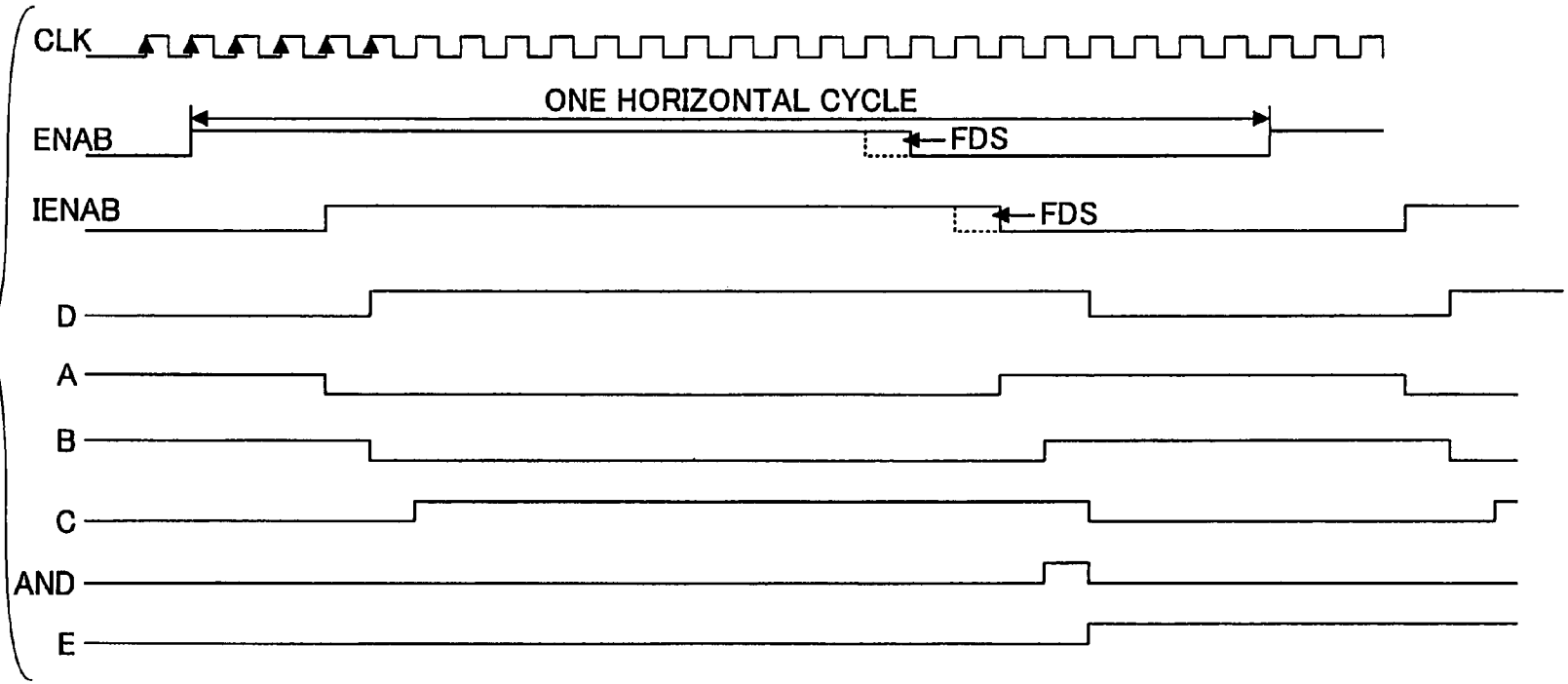
FIG. 8 is a timing chart showing the operation of the circuit of FIG. 7 for a given horizontal cycle.
Figure 9:
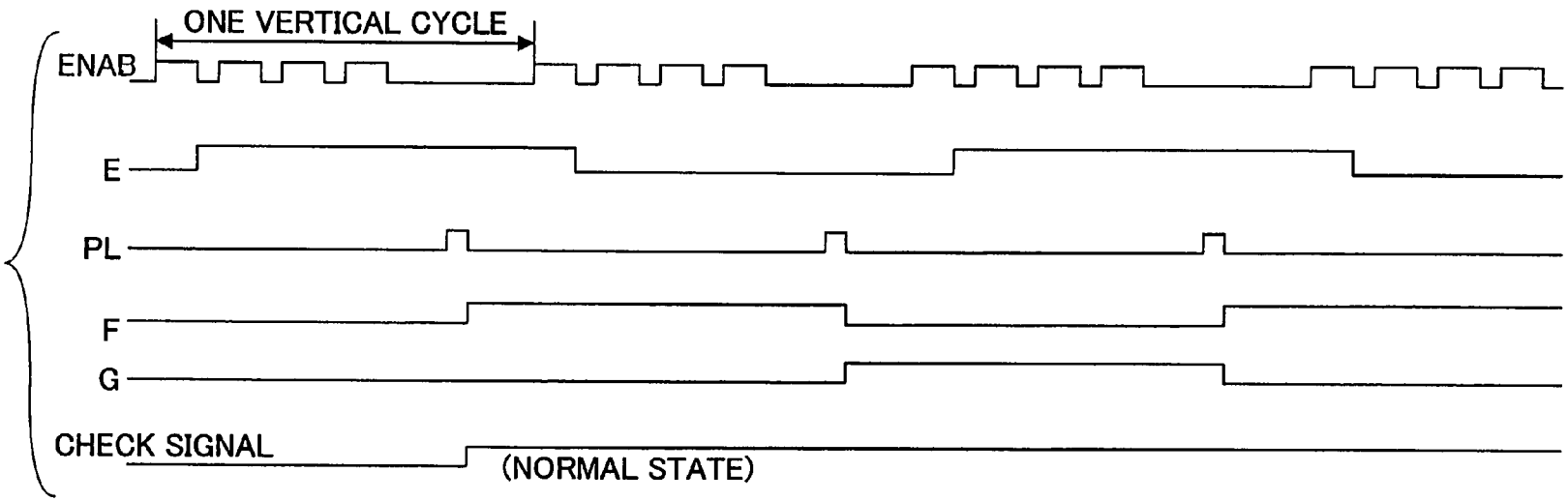
FIG. 9 is a timing chart showing the operation of the circuit of FIG. 7 for a given vertical cycle.

FIG. 8 is a timing chart showing the operation of the circuit of FIG. 7 for a given horizontal cycle. FIG. 9 is a timing chart showing the operation of the circuit of FIG. 7 for each vertical cycle. The operation of the circuit of FIG. 7 will be described with reference to FIG. 8 and FIG. 9.

The individual signals shown in FIG. 8 and FIG. 9 are illustrated in the circuit diagram of FIG. 7 to indicate their positions. A signal A is the output of the inverter 57, a signal B the non-inverted output of the flip-flop 44, a signal C the inverted output of the flip-flop 45, a signal AND the output of the AND gate 58, a signal D the non-inverted output of the flip-flop 49, a signal E the non-inverted output of the flip-flop 50, a signal F the non-inverted output of the flip-flop 51, a signal G the non-inverted output of the flip-flop 52, a signal PL the output of the pulse generating circuit 30, and the check signal the output of the XOR gate 59.

The display enable signal ENAB is supposed to become HIGH only during the valid period of the display data in each horizontal cycle. As shown in FIG. 8, however, the freeze-detection-purpose signal FDS is added at the end of the display enable signal ENAB in each horizontal cycle. The binary counter 54 starts counting the clock pulses of the clock signal CLK from the start of the display enable signal ENAB, and the decoders 55 and 56 decode the counted value. A signal that becomes HIGH in response to a predetermined count output from the decoder 55 is used to set the JK flip-flop 43 to "1", and a signal that becomes HIGH in response to a predetermined count output from the decoder 56 is used to set the JK flip-flop 43 to "0". With this provision, the internal display enable signal IENAB is generated that becomes HIGH for the duration equal to the valid period of the display data.

As shown in FIG. 8, the inverter 57 inverts the internal display enable signal IENAB to produce the signal A. The signal A is delayed by one clock by the flip-flop 44 to generate the signal B. Further, the signal B is delayed by one clock and inverted by the flip-flop 45 to generate the signal C. The AND gate 58 performs an AND operation between the signal B and the signal C, thereby producing the signal AND, which becomes HIGH one clock after the end of the internal display enable signal IENAB.

In order to be aligned with the position of the internal display enable signal IENAB, the display enable signal ENAB is delayed by three clocks by the flip-flops 46 through 48. In order to be aligned with the position of the signal AND, further, the display enable signal delayed by three clocks is delayed by one clock by the flip-flop 49 to generate the signal D. The timing of the freeze-detection-purpose signal FDS contained in this signal D matches the timing of the pulse of the signal AND. The flip-flop 50 loads the signal D by use of the signal AND as an enable signal, thereby generating the signal E indicating the value of the freeze-detection-purpose signal FDS. In the example shown in FIG. 8, the signal E is "1" (HIGH).

Turning to FIG. 9, the signal E generated as described above changes its value from vertical cycle to vertical cycle (i.e., from frame to frame) The pulse generating circuit 30 generates a pulse that becomes HIGH at the end of each frame, as shown in FIG. 9. The flip-flop 51 loads the signal E by use of this pulse as an enable signal, thereby generating the signal F indicating the value of the freeze-detection-purpose signal FDS for each frame.

The flip-flop 52 loads the signal F by use of the pulse of the pulse generating circuit 30 as an enable signal, thereby generating the signal G that is delayed by one vertical cycle (by one frame) from the signal F. The XOR gate 59 performs an exclusive OR operation between the signal F and the signal G to produce the check signal.

Since the freeze-detection-purpose signal FDS is reversed from frame to frame in the normal condition, the signal F is also reversed from frame to frame. The signal G is delayed by one frame from the signal F. It can thus be ascertained that the display data is normal if the signal F and the signal G are different. In this case, the check signal is set to HIGH. If the signal F and the signal G are identical, the freeze-detection-purpose signal FDS is not reversed from frame to frame, which makes it possible to ascertain that the display data is frozen. In this case, the check signal is set to LOW.

Figure 10A:
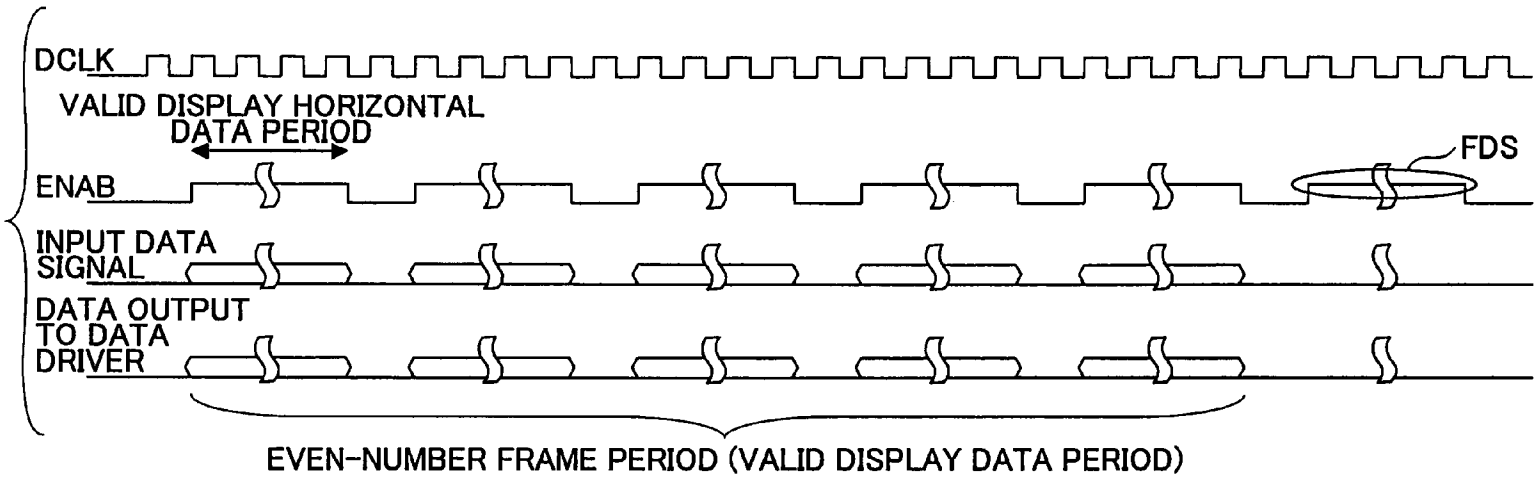
FIGS. 10A and 10B are drawings showing a third embodiment of the freeze-detection-purpose signal.
Figure 10B:
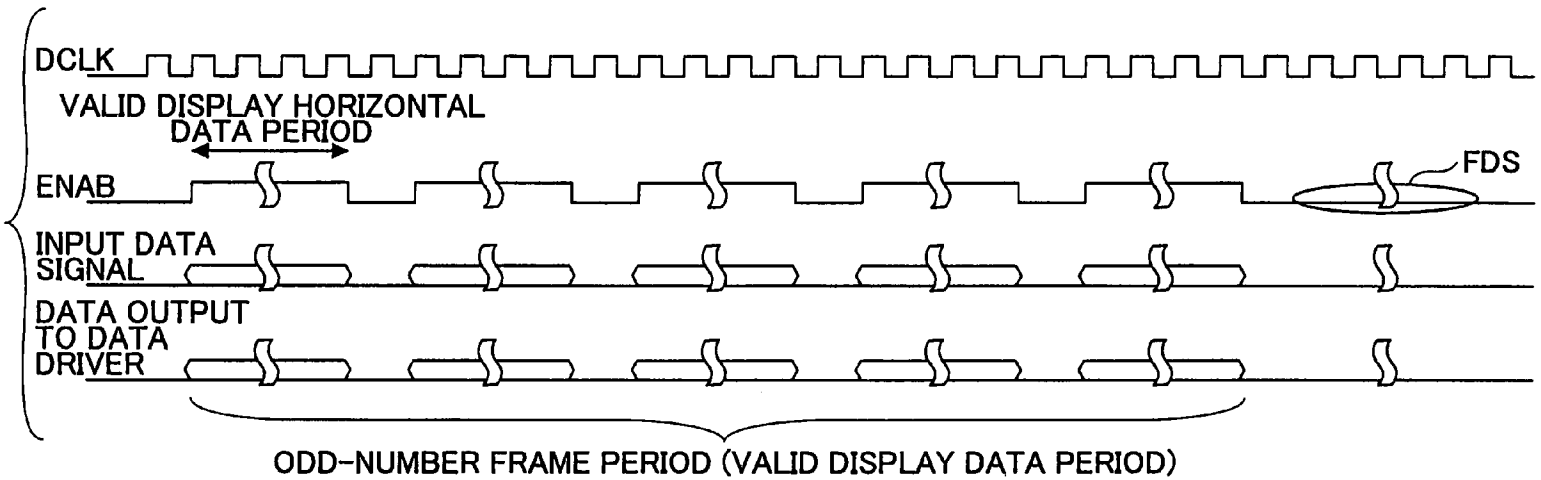

FIGS. 10A and 10B are drawings showing a third embodiment of the freeze-detection-purpose signal. In the third embodiment, as shown in FIGS. 10A and 10B, a freeze-detection-purpose signal FDS is added to the display enable signal ENAB at the end of each frame period (each vertical cycle). The freeze-detection-purpose signal FDS is HIGH ("1") in the even frame as shown in FIG. 10A and LOW ("0") in the odd frame as shown in FIG. 10B. At the liquid crystal display apparatus, a check is made as to whether the freeze-detection-purpose signal FDS is reversed from frame to frame. If the freeze-detection-purpose signal FDS is not reversed from frame to frame, it is ascertained that the display data is frozen, thereby asserting the check signal.

Figure 11:
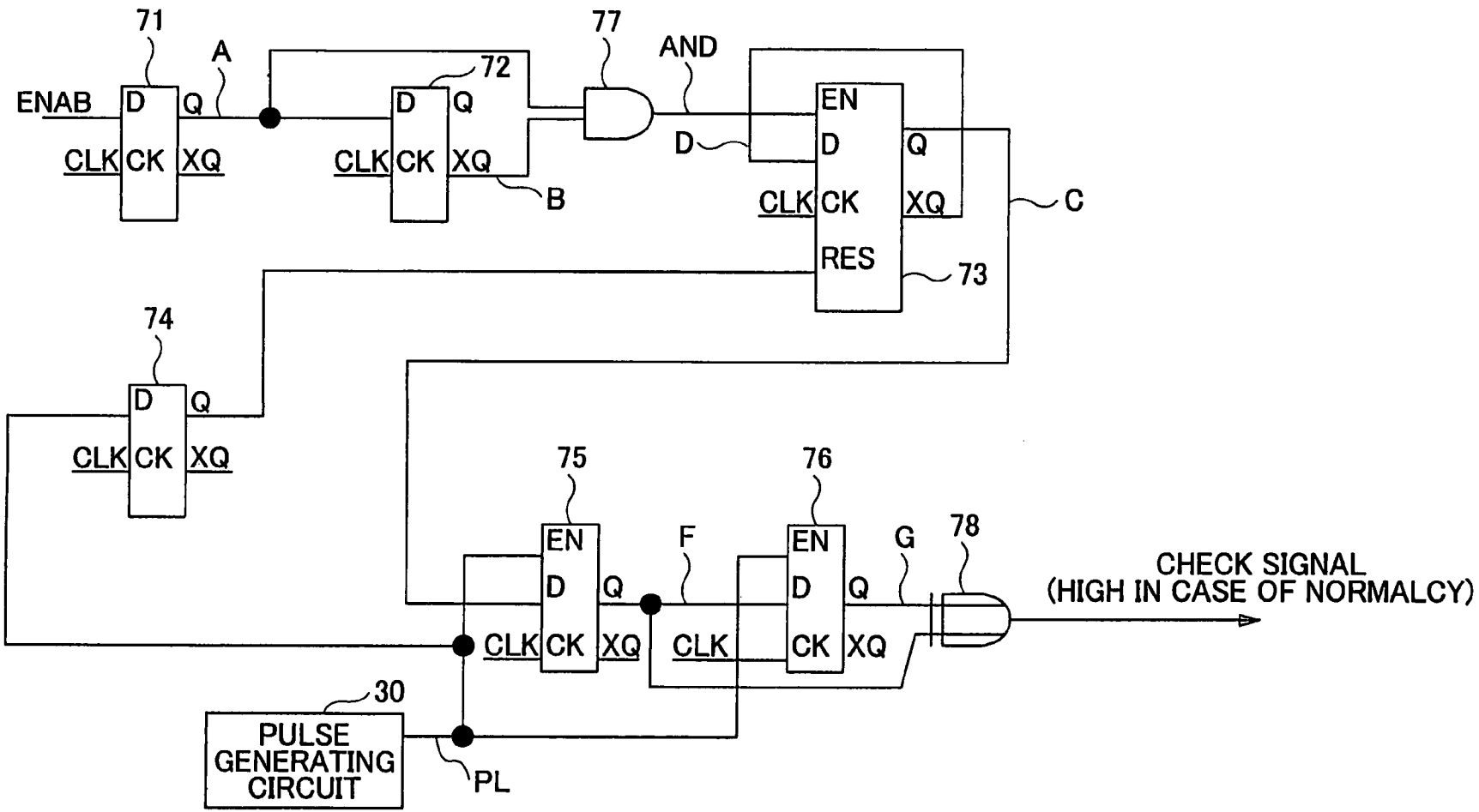
FIG. 11 is a drawing showing an example of the circuit configuration of the check circuit corresponding to the third embodiment.

FIG. 11 is a drawing showing an example of the circuit configuration of the check circuit 20 corresponding to the third embodiment. The check circuit 20 of FIG. 11 includes flip-flops 71 through 76, an AND gate 77, an XOR gate 78, and a pulse generating circuit 30.

The circuit configuration shown in FIG. 11 is designed to generate a check signal based on the freeze-detection-purpose signal when the freeze-detection-purpose signal is added to the display enable signal ENAB at the end of each frame period (i.e., each vertical cycle). The circuit portion comprised of the flip-flop 71, the flip-flop 72, the AND gate 77, and the flip-flop 73 generates a toggle signal that is inverted at a rising edge of the display enable signal ENAB.

The flip-flop 74 serves to reset the flip-flop 73 in response to a pulse generated by the pulse generating circuit 30 that is asserted at the end of each vertical cycle (i.e., at the end of each frame). The circuit portion comprised of the flip-flop 75, the flip-flop 76, and the XOR gate 78 performs an XOR (exclusive OR) operation, based on the pulse generated by the pulse generating circuit 30, between the value of the freeze-detection-purpose signal of a given frame and the value of the freeze-detection-purpose signal of the following frame. As a result, the check signal becomes LOW that is an asserted state to indicate an anomaly if the value of the freeze-detection-purpose signal of a given frame is the same as the value of the freeze-detection-purpose signal of the next frame. The check signal becomes HIGH that is a negated state to indicate a normal state if the situation is normal, i.e., if the value of the freeze-detection-purpose signal of a given frame differs from the value of the freeze-detection-purpose signal of the next frame.

Figure 12:
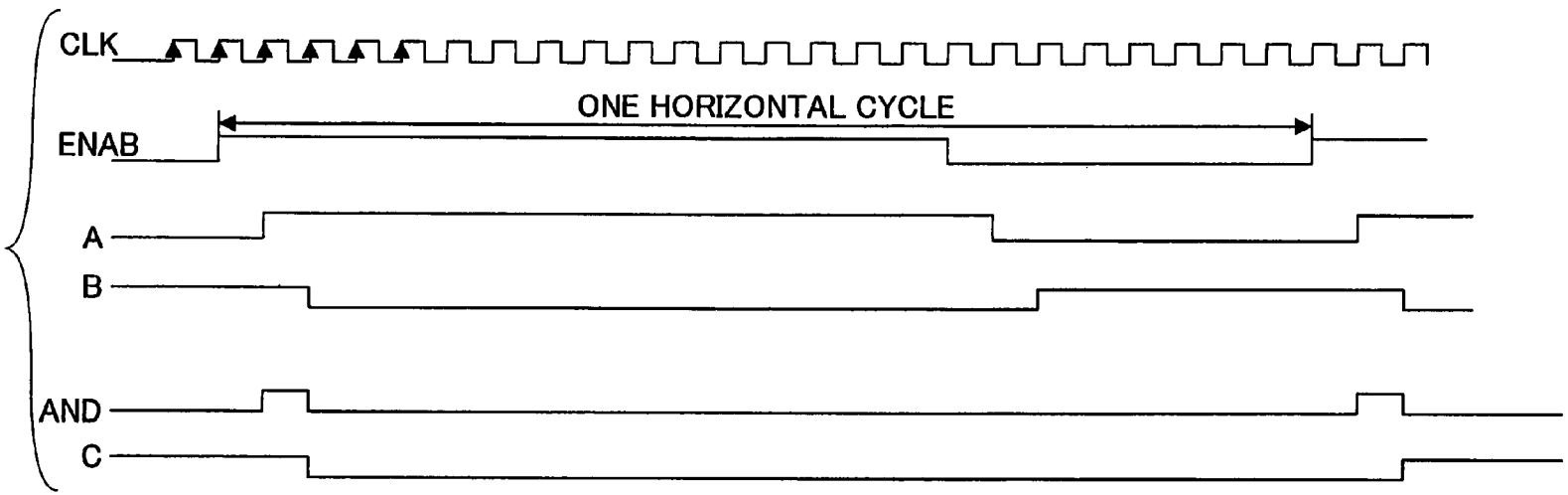
FIG. 12 is a timing chart showing the operation of the circuit of FIG. 11 for a given horizontal cycle.
Figure 13:
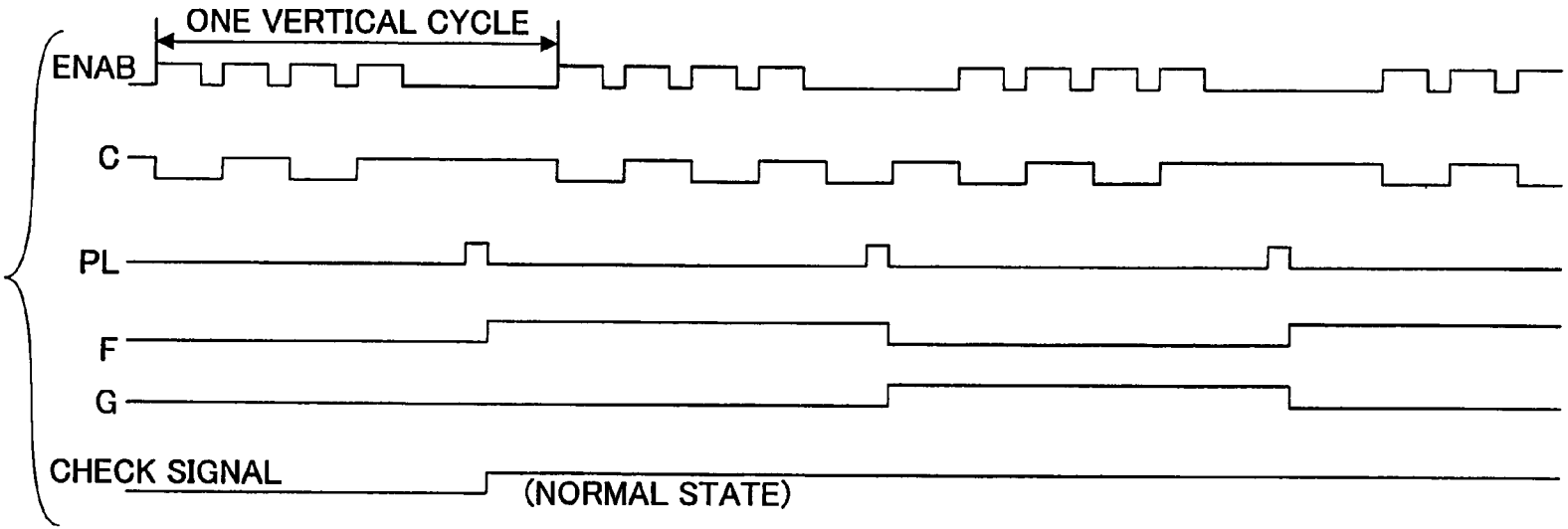
FIG. 13 is a timing chart showing the operation of the circuit of FIG. 11 for a given vertical cycle.

FIG. 12 is a timing chart showing the operation of the circuit of FIG. 11 for a given horizontal cycle. FIG. 13 is a timing chart showing the operation of the circuit of FIG. 11 for each vertical cycle. The operation of the circuit of FIG. 11 will be described with reference to FIG. 12 and FIG. 13.

The individual signals shown in FIG. 12 and FIG. 13 are illustrated in the circuit diagram of FIG. 11 to indicate their positions. A signal A is the non-inverted output of the flip-flop 71, a signal B the inverted output of the flip-flop 72, a signal C the non-inverted output of the flip-flop 73, a signal AND the output of the AND gate 77, a signal D the inverted output of the flip-flop 73, a signal F the non-inverted output of the flip-flop 75, a signal G the non-inverted output of the flip-flop 76, a signal PL the output of the pulse generating circuit 30, and the check signal the output of the XOR gate 78.

As shown in FIG. 12, the display enable signal ENAB is delayed by one clock by the flip-flop 71 to generate the signal A. The signal A is delayed by one clock and inverted by the flip-flop 72 to generate the signal B. The AND gate 77 performs an AND operation between the signal A and the signal B, thereby producing the signal AND, which becomes HIGH in response to a rising edge of the display enable signal ENAB.

The flip-flop 73 uses the signal AND as an enable signal to load the signal D, which is the non-inverted output of the flip-flop 73 itself, thereby generating the toggle signal C that is inverted in response to the signal AND. The toggle signal C is inverted in response to a rising edge of the display enable signal ENAB.

Turning to FIG. 13, the toggle signal C generated as described above changes its value each time the display enable signal ENAB exhibits a rise. The pulse generating circuit 30 generates a pulse that becomes HIGH at the end of each frame, as shown in FIG. 13. The toggle signal C is reset by this pulse (to become HIGH). Namely, the toggle signal C starts with a HIGH state (i.e., reset state) at the start of each frame, and repeats a toggling operation in response to the display enable signal ENAB included in the frame.

If the number of the display enable signals ENAB contained in one frame is an even number, the toggle signal C is HIGH immediately before the end of the frame. If the number of the display enable signals ENAB contained in one frame is an odd number, the toggle signal C is LOW immediately before the end of the frame. That is, the value of the toggle signal C immediately before a fame end differs between the case in which the HIGH freeze-detection-purpose signal FDS is attached to the display enable signal ENAB as in the even frame shown in FIG. 10A and the case in which the LOW freeze-detection-purpose signal FDS is attached to the display enable signal ENAB as in the odd frame shown in FIG. 10B.

The flip-flop 75 loads the toggle signal C by use of the pulse generated by the pulse generating circuit 30 as an enable signal, thereby generating the signal F indicating the value of the freeze-detection-purpose signal FDS for each frame. The flip-flop 76 loads the signal F by use of the pulse of the pulse generating circuit 30 as an enable signal, thereby generating the signal G that is delayed by one vertical cycle (by one frame) from the signal F. The XOR gate 78 performs an exclusive OR operation between the signal F and the signal G to produce the check signal.

Since the freeze-detection-purpose signal FDS is reversed from frame to frame in the normal condition, the signal F is also reversed from frame to frame. The signal G is delayed by one frame from the signal F. It can thus be ascertained that the display data is normal if the signal F and the signal G are different. In this case, the check signal is set to HIGH. If the signal F and the signal G are identical, the freeze-detection-purpose signal FDS is not reversed from frame to frame, which makes it possible to ascertain that the display data is frozen. In this case, the check signal is set to LOW.

Figure 14A:
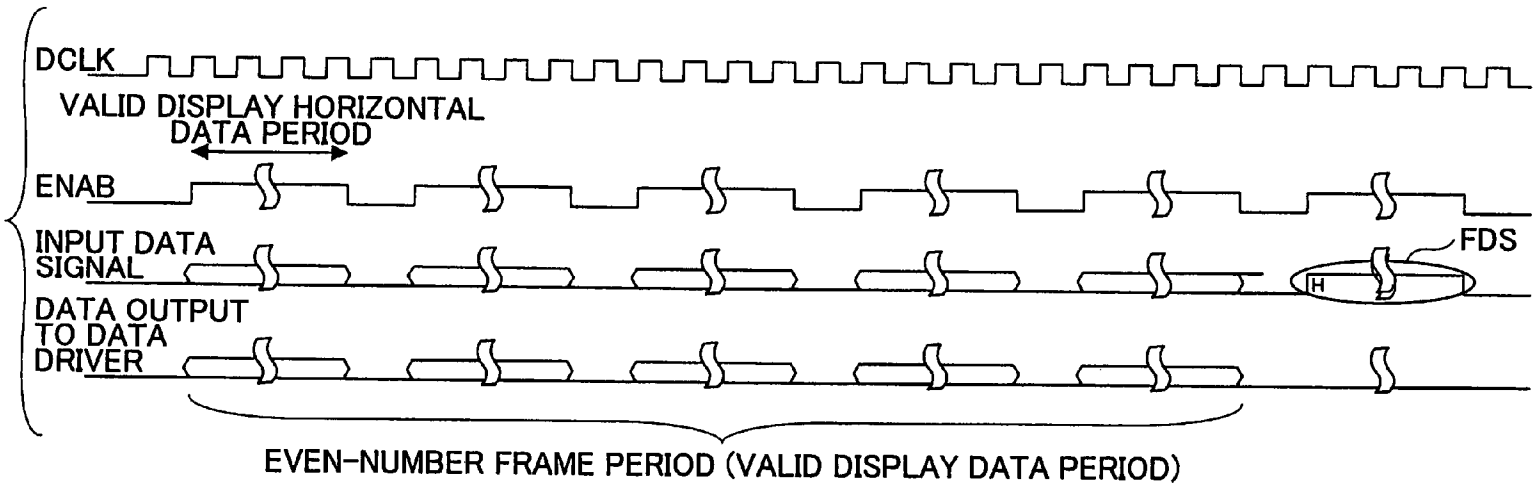
FIGS. 14A and 14B are drawings showing a fourth embodiment of the freeze-detection-purpose signal.
Figure 14B:
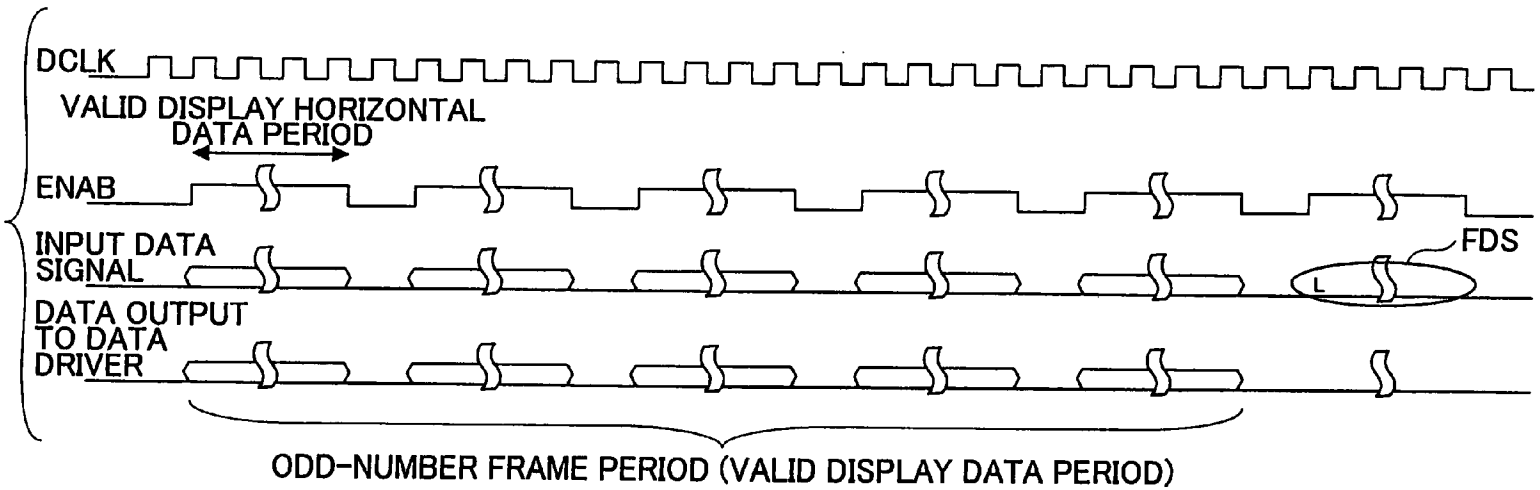

FIGS. 14A and 14B are drawings showing a fourth embodiment of the freeze-detection-purpose signal. In the fourth embodiment, as shown in FIGS. 14A and 14B, a freeze-detection-purpose signal FDS is added to an input data signal at the end of each frame period (each vertical cycle). The freeze-detection-purpose signal FDS is HIGH ("1") in the even frame as shown in FIG. 14A and LOW ("0") in the odd frame as shown in FIG. 14B. At the liquid crystal display apparatus, a check is made as to whether the freeze-detection-purpose signal FDS is reversed from frame to frame. If the freeze-detection-purpose signal FDS is not reversed from frame to frame, it is ascertained that the display data is frozen, thereby asserting the check signal.

Further, the present invention is not limited to these embodiments, but various variations and modifications may be made without departing from the scope of the present invention.

The signal and position to which a freeze-detection-purpose signal is added is not limited to the configurations of the above-described embodiments. Further, although the above embodiments have been described with reference to a case in which the freeze-detection-purpose signal is reversed (inverted) from frame to frame, this signal is not limited to the signal that switches between HIGH and LOW, and suffices if it changes in one way or another from frame to frame. Further, this signal does not necessarily have to change for every single frame. A signal that changes once in every two frames, for example, may as well be used as a freeze-detection-purpose signal of the present invention.

The present application is based on Japanese priority application No. 2005-084543 filed on Mar. 23, 2005, with the Japanese Patent Office, the entire contents of which are hereby incorporated by reference.

What is claimed is:

1. A liquid crystal display apparatus, comprising:

a liquid crystal panel;

a driver configured to drive the liquid crystal panel;

a control circuit configured to control the driver in response to a display data signal and control signal supplied from an exterior, the display data signal including display data that is to be displayed on the liquid crystal panel; and a check circuit configured to detect a change between frames in a freeze-detection-purpose signal that is included in at least one of the display data signal and control signal so as to output a check signal responsive to presence/absence of the change, the freeze-detection-purpose signal being independent of the display data to be displayed on the liquid crystal panel and configured to change at intervals, wherein the check circuit is configured to detect whether the freeze-detection-purpose signal has a value that is inverted from frame to frame and the display data is frozen when the freeze-detection-purpose signal is not inverted from frame to frame.

2. The liquid crystal display apparatus as claimed in claim 1, wherein the check circuit is configured to detect the change of the freeze-detection-purpose signal that is included in the display data signal at a portion of the display data signal other than a period of valid display data.

3. The liquid crystal display apparatus as claimed in claim 1, wherein the check circuit is configured to detect the change of the freeze-detection-purpose signal that is included in the control signal at a portion corresponding to other than a period of valid display data of the display data signal.

4. The liquid crystal display apparatus as claimed in claim 1, wherein the liquid crystal panel displays a predetermined indication in response to a predetermined condition of the check signal output from the check circuit.

5. The liquid crystal display apparatus as claimed in claim 1, wherein the check signal output from the check circuit is transmitted to an exterior of the apparatus.

6. A control circuit configured to be connectable to a unit that includes a liquid crystal panel and a driver for driving the liquid crystal panel, and configured to control the driver based on a display data signal and control signal supplied from an exterior, the display data signal including display data that is to be displayed on the liquid crystal panel, the control circuit comprising:

a check circuit configured to detect a change between frames in a freeze-detection-purpose signal that is included in at least one of the display data signal and control signal so as to output a check signal responsive to presence/absence of the change, the freeze-detection-purpose signal being independent of the display data to be displayed on the liquid crystal panel and configured to change at intervals, wherein the check circuit is configured to detect whether the freeze-detection-purpose signal has a value that is inverted from frame to frame and the display data is frozen when the freeze-detection-purpose signal is not inverted from frame to frame.

7. A method of checking liquid crystal display data, comprising:

receiving a display data signal and control signal, the display data signal including display data that is to be displayed on a liquid crystal panel;

controlling a driver for driving a liquid crystal panel based on the display data signal and control signal;

detecting a change between frames in a freeze-detection-purpose signal that is included in at least one of the display data signal and control signal, the freeze-detection-purpose signal being independent of the display data to be displayed on the liquid crystal panel and configured to change at intervals; and generating a check signal responsive to presence/absence of the change, wherein the step of detecting a change detects whether the freeze-detection-purpose signal has a value that is inverted from frame to frame and the display data is frozen when the freeze-detection-purpose signal is not inverted from frame to frame.

* * * * *